US006138942A

United States Patent [19]

DesRosiers et al.

[11] Patent Number: 6,138,942

[45] **Date of Patent: *Oct. 31, 2000**

[54] SPOOL HAVING RADIAL SUPPORT RIBS ON THE FLANGE

[75] Inventors: Victor J. DesRosiers, Kinderhook; Joseph Ahrberg, Hoosic Falls; James Wilkinson, East Greenbush, all of N.Y.

[73] Assignee: Sonoco Development, Inc., Hartsville, S.C.

[ * ] Notice: This patent is subject to a terminal disclaimer.

[21] Appl. No.: 09/245,624

[22] Filed: Feb. 5, 1999

Related U.S. Application Data

[63] Continuation of application No. 08/796,773, Feb. 6, 1997, Pat. No. 5,868,349.

[51] Int. Cl.[7] ..... B65H 75/08

[52] U.S. Cl. ..... 242/614.1; 242/610.6; 242/613; 242/613.4

[58] Field of Search ..... 242/614.1, 610.6, 242/613, 613.4, 608.4, 118.4, 118.6, 118.61, 118.62

[56] References Cited

U.S. PATENT DOCUMENTS

| | | |
|---|---|---|
| 773,218 | 10/1904 | Mossberg . |
| 877,398 | 1/1908 | Brinley . |
| 962,453 | 6/1910 | Mossberg . |
| 1,175,953 | 3/1916 | Holt . |
| 1,207,043 | 12/1916 | Holt . |
| 1,341,817 | 6/1920 | Mossberg . |
| 1,380,671 | 6/1921 | Mossberg . |
| 1,448,355 | 3/1923 | Bowen . |
| 1,484,153 | 2/1924 | Peterson . |
| 1,911,427 | 5/1933 | Bureau . |
| 2,010,821 | 8/1935 | Lewis et al. . |
| 2,049,558 | 8/1936 | Dunlap . |
| 2,159,469 | 5/1939 | Boswin . |
| 2,177,096 | 10/1939 | Craig . |
| 2,194,795 | 3/1940 | Johnson . |
| 2,264,116 | 11/1941 | Howsam . |
| 2,321,084 | 6/1943 | Howsam et al. . |
| 2,331,954 | 10/1943 | Atwood . |
| 2,344,132 | 3/1944 | Coxe . |
| 2,411,937 | 12/1946 | Powell . |
| 2,503,374 | 4/1950 | Bureau . |
| 2,601,660 | 6/1952 | Jarmicki . |
| 2,898,057 | 8/1959 | Curry . |
| 3,025,021 | 3/1962 | McCluer et al. . |
| 3,452,946 | 7/1969 | Starratt . |
| 3,468,495 | 9/1969 | Starratt . |
| 3,542,308 | 11/1970 | Starratt . |
| 3,591,103 | 7/1971 | Hafner . |
| 3,591,104 | 7/1971 | Hafner . |
| 3,670,987 | 6/1972 | Roebuck . |
| 3,743,208 | 7/1973 | Schmitz . |
| 3,753,533 | 8/1973 | Lyman . |
| 4,403,753 | 9/1983 | Gibas et al. . |
| 4,462,324 | 7/1984 | Larsen . |
| 4,512,532 | 4/1985 | Dittrich . |
| 4,657,203 | 4/1987 | Crawford . |
| 4,997,141 | 3/1991 | Pasini . |
| 5,064,135 | 11/1991 | Williamson et al. . |
| 5,330,127 | 7/1994 | Hafner . |
| 5,409,180 | 4/1995 | Stewing . |

FOREIGN PATENT DOCUMENTS

| | | | |
|---|---|---|---|
| 2529102 | 1/1977 | Germany | 242/118.4 |
| 60-246072 | 12/1985 | Japan | 242/610.6 |
| 275387 | 5/1951 | Switzerland | 242/118.4 |
| 305394 | 5/1955 | Switzerland | 242/118.4 |

*Primary Examiner*—Donald P. Walsh
*Assistant Examiner*—William A. Rivera
*Attorney, Agent, or Firm*—Seidel, Gonda, Lavorgna & Monaco, PC

[57] ABSTRACT

A reel or spool for winding or unwinding of cable, wire, or the like includes a hub having a cylindrical wall defining an outer barrel surface and an axial end wall suitable for the application of labels or other identification indicia. A flange extends radially from the outer barrel adjacent each end wall. The flanges have a plurality of integrally formed, radially extending ribs disposed on their outer surface. The connection between the ribs, the axial end wall and the barrel surface of the hub being within the radial extent of the cylindrical wall. In one form of the invention, the hub includes an inclined wall connecting the cylindrical wall, the axial end wall and the ribs.

13 Claims, 3 Drawing Sheets

SPOOL HAVING RADIAL SUPPORT RIBS ON THE FLANGE

This is a continuation of application Ser. No. 08/796,773 filed on Feb. 6, 1997 which will issue as U.S. Pat. No. 5,868,349 on Feb. 9, 1999.

FIELD OF THE INVENTION

The present invention pertains to a reel or spool for holding wire, cable, or the like. In particular, the invention relates to a reel or spool having a connection between its hub and flanges which eliminates the direct transfer of force along the reinforcing ribs on the flanges, limiting the possibility of failure.

BACKGROUND OF THE INVENTION

Typically, a reel or spool is used for retaining a winding of cable, wire, or the like. Reels generally comprise a hub having a cylindrical wall defining an outer barrel surface. A disk shaped flange is provided on at least one end of the hub. The flange projects radially outwardly from the barrel surface. An axial end wall is sometimes also provided. The end wall provides a surface which is suitable for the application of a label or other identifying indicia for the winding.

In some reels, the flange is provided with radially extending ribs. In a typical plastic reel, the ribs are integrally formed with the other portions of the flange. The ribs stiffen the flange to prevent bowing or fracture and protect the cable.

It has been found that certain adverse forces applied to the flange of a typical reel may cause failure of the flange material in the area of the connection between the ribs and the hub. It is desirable to create a reel structure that prevents or limits this type of failure.

SUMMARY OF THE INVENTION

The present invention relates to a reel or spool having an improved connection between the ribs on the flange and the axial end wall and/or hub portions. In one form of the invention the connection between the ribs and the hub is created by an inclined wall which extends between the connection of the flange, the cylindrical wall of the hub and the axial end wall portion. In another form of the invention the connection between the ribs, the reel hub and the axial end wall is created inwardly of the outer surface of the hub.

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
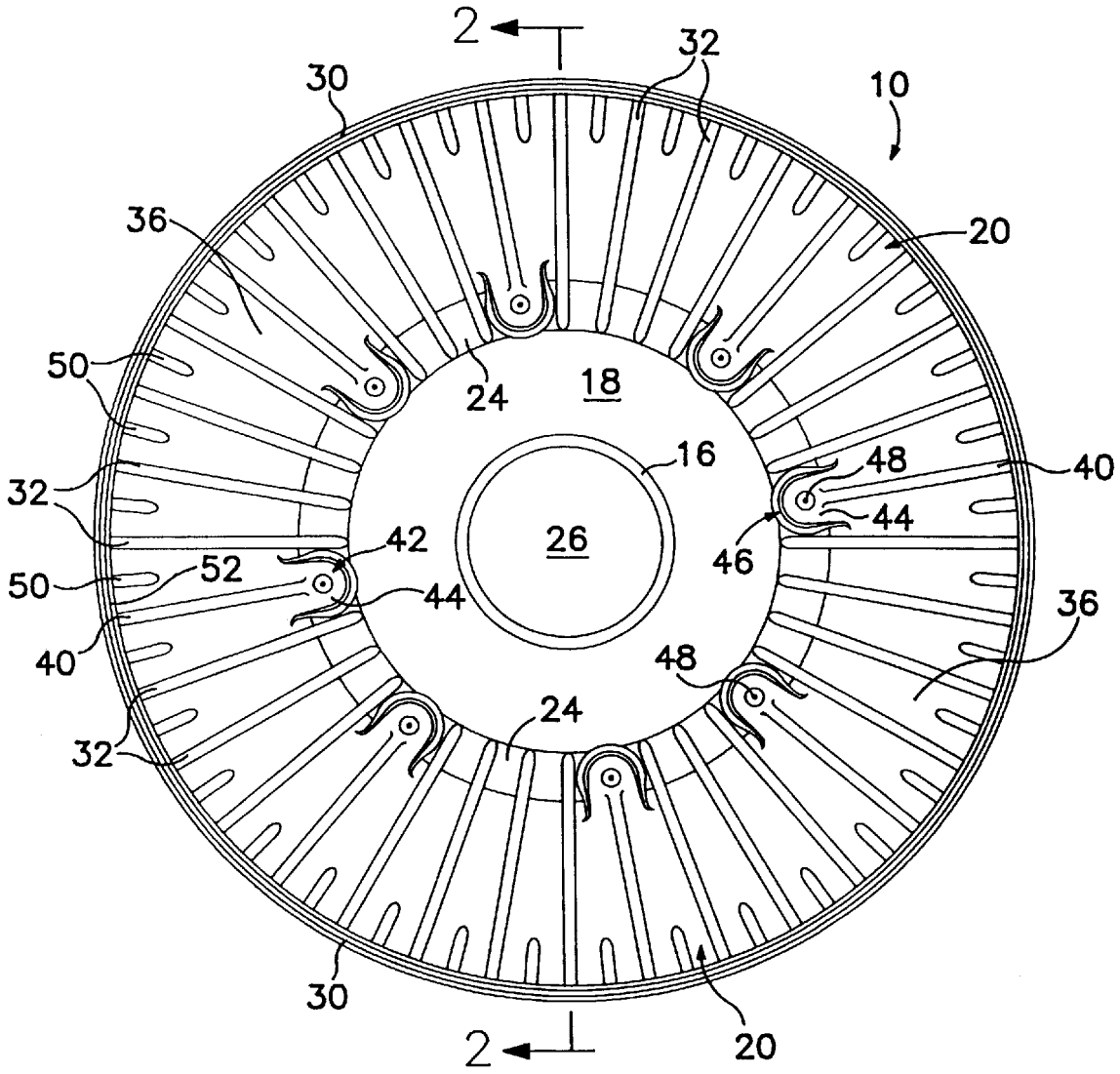
FIG. 1 shows a plan view of one-half of a reel according to one embodiment of the present invention.

In the drawings, where like numerals identify similar elements, there is shown various forms of the invention which are presently preferred.

Figure 2:
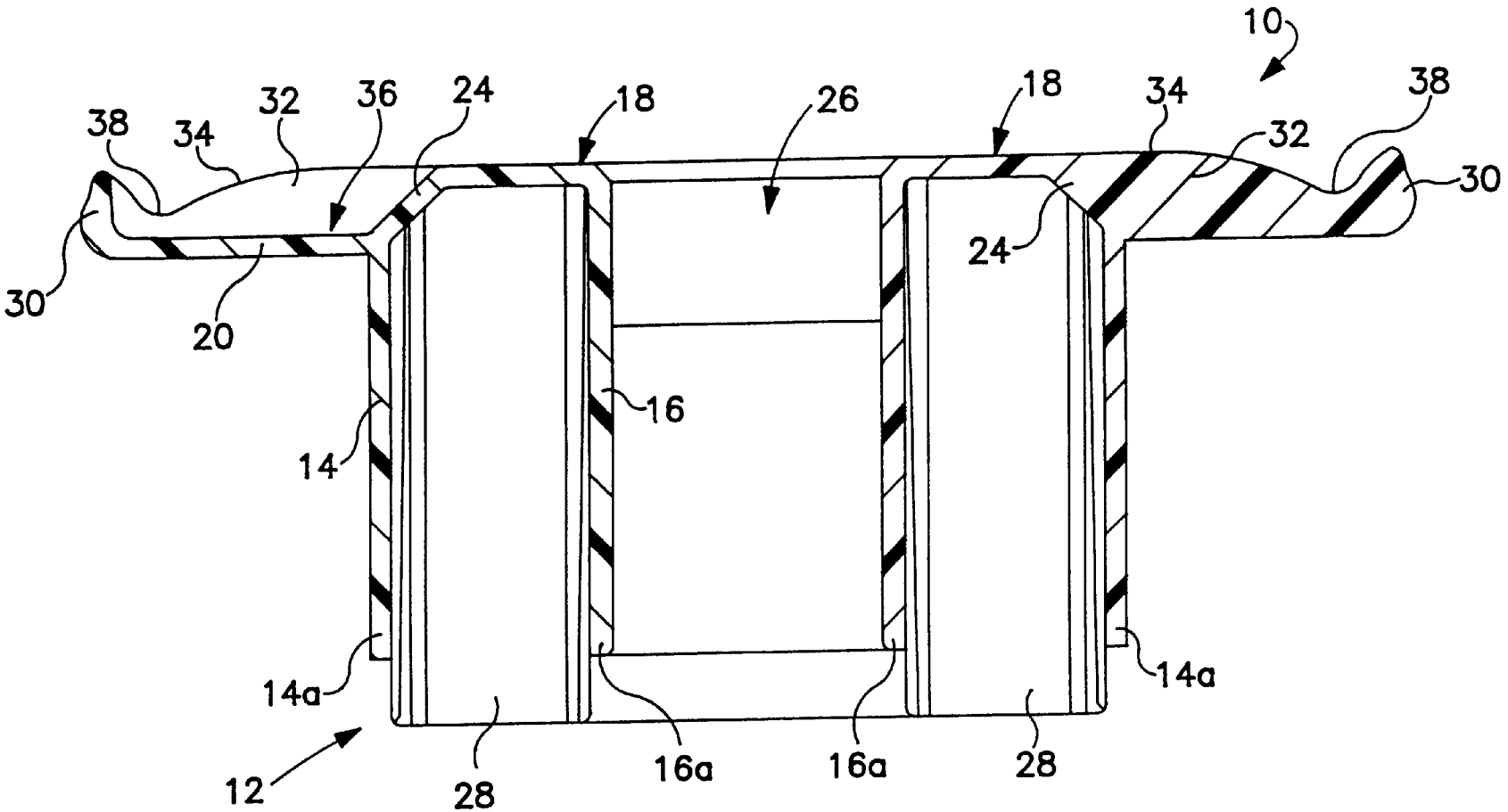
FIG. 2 is a cross-section of the reel taken along the line 2—2 in FIG. 1.

In FIGS. 1 and 2 there is shown a reel or spool which is generally designated by the numeral 10. In FIG. 1, there is shown the top of the reel 10. In FIG. 2, one half of the reel 10 is shown in cross-section. A complete reel, on which wire, cable, yarn, or the like can be wound, is formed by joining two reel halves in an end-to-end relationship, as described in more detail below.

Each half of reel 10 includes a hub or central core 12 having an outer annular wall 14 and a coaxial inner wall 16. The outer wall 14 functions as the barrel winding surface for the cable or wire. An axial end wall 18 is provided at one end of the inner wall 16. As illustrated, the end wall forms a disk-shaped portion 18. Also provided is a radially extending flange 20 which extends from the outer wall 14. As best seen in FIG. 2, the end wall 18 is formed on a different plane from the flange 20. The end wall 18 extends radially from, at least, the inner wall 16 and provides a suitable surface for the application of labels or indicia (not shown). An angled wall 24 extends radially from the peripheral edge of the end wall 18 and connects with the outer wall 14 adjacent its connection with the flange 20.

The inner wall 16 forms a central passage or hollow shaft 26 within the core 12. The shaft 26 provides a surface by which the reel 10 may be rotatably mounted on a spindle or the like (not shown), while cable or wire (also not shown) is wound onto or unwound from the reel 10. The inner wall 16 is beveled at the entrance of the shaft 26 to facilitate receiving the spindle.

A plurality of ribs 28 are provided within the annulus formed between the inner wall 16 and the outer wall 14 of the central core 12. The ribs 28 extend radially and are preferably integrally formed with the walls of the central core 12. The ribs 28 extend below the lower edges 14*a* and 16*a* of the outer wall 14 and inner wall 16, respectively. When the two halves of the reel 10 are joined, the extending portions of the ribs 28 are engaged with the annulus between the outer wall 14 and the inner wall 16 of the opposing half of the reel. The ribs 28 serve to reinforce the core 12 of the reel 10.

The outer edge of the flange 20 is provided with an upstanding wall or lip 30. A series of integral ribs 32 are formed on the upper surface of the flange 20, between the lip 30 and the angled wall 24. The contour of each rib 32 is best seen in FIG. 2. The top surface 34 of each rib 32 is coplanar with the disk-shaped portion 18 in the vicinity of the angled wall 24. The ribs 32 gradually taper toward the upper face surface 36 of the flange 20 as it extends radially outwardly. The top surface 34 of the ribs 32 reach a low point 38 at a position radially inwardly of the lip 30. The ribs 32 then taper upwardly until they meet with the inside surface of the lip 30.

As best seen in FIG. 1, series of relatively shorter ribs 40 are also integrally formed on the upper surface 36 of the flange 20. The ribs 40 are similar to the other (longer) ribs 32 except that they taper into the upper face 36 of the flange 20 before reaching the angled wall 24. This construction also eliminates the conventional transverse connection between the flange and barrel.

As best seen in FIG. 1, a plurality of U-shaped recesses 42 are evenly spaced around the periphery of the central hub 12.

The recesses 42 are formed in the end wall 18 of the central hub 12 in the vicinity of the angled wall 24. Each recess 42 includes a bottom wall 44, which is generally co-planar with the upper surface 36 of the flange 20. An upstanding wall 46 extends around the periphery of the bottom wall 44 and defines the recess 42. Each recess 42 is provided with a hole or opening 48 formed in the bottom wall 44. A fastener, such as a bolt (not shown), is inserted into the hole 48 and extends through the space between inner wall 16 and outer wall 14 of core 12 to a corresponding hole in the opposing reel half. A nut (also not shown) is provided on the end of the bolt to secure the two reel halves together to form the reel 10.

An intermediate rib 50 is provided between each of the ribs 32 and 40. The intermediate ribs 50 extend from the top edge 52 of the peripheral lip 30 and taper toward the upper face 36 of the flange 20 at an angle of approximately 45°. The intermediate ribs 50 serve to strengthen and stiffen the lip 30 and the peripheral edge of the flange 20.

The bolted construction of the reel enhances the possibility of reuse because damaged components can be easily replaced and all parts can be recycled. The two reel halves also may be joined by any suitable means known to those skilled in the art, such as adhesives, depending upon the size and the loading requirements of the reel. It will also be noted that the geometry of recesses 42 can be altered or the recesses eliminated altogether depending upon the desired requirements for the reel.

The flange 20 extends radially from the axial end of the outer annular wall 14 at the point where it meets the angled wall 24. Each rib 32, 40 extends radially from the peripheral lip 30 of the flange 20 to the angled wall 24 (except where a rib would intersect with a recess 42). This angled connection eliminates the high stress concentration which normally occurs when the ribs are formed directly with the outer wall 14. The angled portion 24 allows the flange 20 to deflect when the reel 10 impacts a hard surface, such as when the reel is dropped, within the stress limitations of the plastic material of the reel.

The angled wall 24 is depicted as having an angle of 45° from the vertical. Using this angle for the wall 24, for a reel 10 having a flange diameter of 630 mm, the end wall 18 is of sufficient diameter to accommodate a label having the necessary identification markings. The angle of the wall 24 can be increased (with respect to the vertical), although this in effect decreases the overall size of the surface to be used for the application of labels or indicia. The angle may also be decreased as desired.

Figure 3:
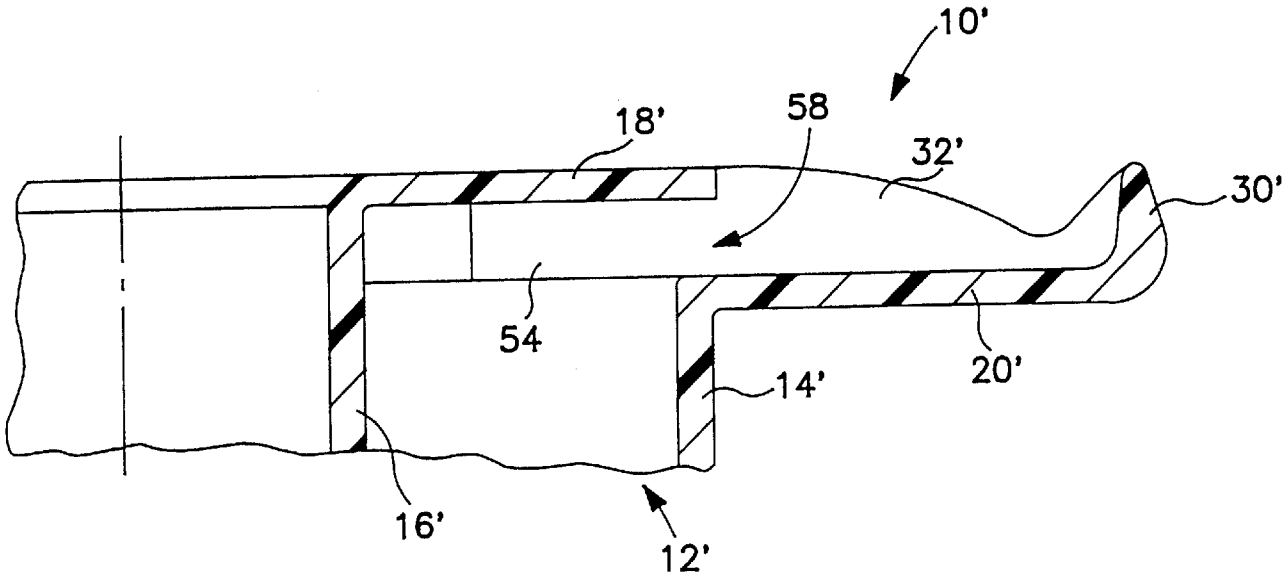
FIG. 3 is an enlarged fragmentary cross-section of a reel according to a second embodiment of the present invention.

Another embodiment of the present invention is illustrated in FIG. 3. The reel half 10' of this embodiment is similar to reel half 10 of FIGS. 1 and 2 except that there is no angled connection between the flange 20', ribs 32' and end wall 18'. The end wall 18' extends from the inner annular wall 16' to the location of the outer annular wall 14'. The end wall 18' is not directly attached to the outer wall 14'. An opening 58 is formed between the outer wall 14' and the end wall 18'. Also, an internal extension 54 of the rib 32' is provided radially inwardly of the peripheral edge of the end wall 18'.

The rib extension 54 extends within the space between the inner wall 16' and outer wall 14'. As illustrated, the inner edge of the rib 32' is spaced from the inner wall 16'. However, it is contemplated that the extension 54 could also extend to the inner wall 16', if desired.

Figure 4:
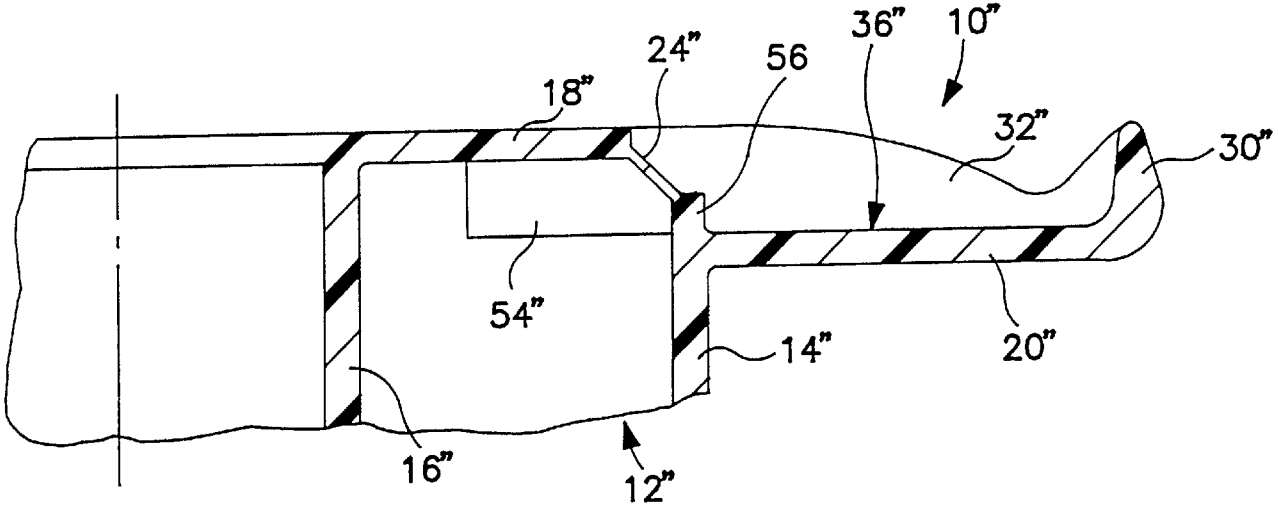
FIG. 4 is an enlarged fragmentary cross-section of a reel according to a third embodiment of the present invention.

In FIG. 4 there is illustrated a third embodiment of the present invention. The reel 10" is similar to the reel of the other embodiments except that the end wall 18" of the central core 12" includes an angled portion 24" which has a reduced cross-sectional thickness as compared to that of such portions as inner wall 16" and outer wall 14". In addition, the ribs 32" include an extension 54" similar to that contemplated in reel 10' in FIG. 3. The outer wall 14" also includes an upward extension 56 which is positioned vertically above the face 36" of the flange 20". The angled portion 24" extends between the end wall 18" and the extension 56 of the outer wall 14".

The ribs on the flange are provided to substantially stiffen the flange. The ribs assist in reducing axial deflection of the flange due to the winding of the cable or wire on the barrel surface of the central core. The ribs also strengthen the connection between the flange and the core, particularly when the reel is subject to an impact such as by being dropped on the lip of the flange.

Prior to the present invention, reels of this type were constructed with the outer wall extending axially above the flange surface and communicating directly with the axial end wall. The flange ribs were attached to this outer wall. This construction creates a stress maximum on the flange directly along the connection to the outer wall. In an unloaded condition, i.e., where there is no cable or wire wound thereon, upon an impact to the flange, the stress at this location is often sufficient to cause failure of the material.

The provision of an angled wall between the outer wall of the central core and the axial end wall serves to modify the flexing of the flange where the ribs meet the central core. The stress concentration is sufficiently relieved such that failure of the rib material is substantially eliminated.

In the alternate embodiments of the invention, the structural communication between the flange, the outer wall and the axial end walls is created by the integral rib extensions 54, 54". Upon flexing of the flange, the outer wall serves as a pivot about which the ribs can rotate. This structure limits stress concentration along the ribs and substantially eliminates failure of the rib material.

Another structural requirement for the invention is the provision of the axial end wall having sufficient surface area for the application of a label or other identifying indicia. In a reel that is to be formed by an injection molding process, which is presently preferred for the invention, the peripheral edge of the end wall is limited to the inner diameter of the outer wall due to molding constraints. The limitations on the angled wall are dictated by this requirement. The closer the angled wall comes to being perpendicular to the longitudinal axis of the reel, the smaller the surface area of the axial wall. Conversely, the steeper the angle, i.e., the closer the wall is to vertical, the more concentrated the stress at the junction between the ribs and the wall.

The present invention may be embodied in other specific forms without departing from the spirit or essential attributes thereof and, accordingly, reference should be made to the appended claims, rather than to the foregoing specification, as indicating the scope of the invention.

What is claimed is:

1. A reel comprising:

a central hub, the central hub having a cylindrical wall defining an outer barrel surface, the cylindrical wall extending the length of the central hub, the hub also having a pair of axial end walls at opposite ends of the barrel surface;

a pair of annular flanges extending radially outward from and integrally formed with the barrel surface adjacent each axial end wall, each flange positioned axially inward from a corresponding end wall, each flange having an inwardly facing surface and defining with the barrel surface a strand winding area, each flange also having an outwardly facing surface;

a pair of inclined annular walls, the inclined walls forming an integral connection between the cylindrical wall and the axial end walls, the connection with the axial end wall being radially inward and axially outward of the cylindrical wall;

a plurality of radially extending stiffening ribs comprising uppermost and lowermost surfaces, the lowermost surface of the stiffening ribs disposed on and integrally formed with the outwardly facing surface of each of the flanges, the uppermost surface of the stiffening ribs terminating at the connection between the inclined annular wall and the cylindrical wall;

a plurality of radially extending ribs integrally formed with and extending inwardly from the inclined annular walls, the ribs being angularly offset from the stiffening ribs; and the hub, flanges, ribs and inclined walls formed from a thermoplastic material.

2. The reel according to claim 1 wherein the angle of the inclined walls is between about 45° and about 90° from vertical.

3. The reel according to claim 2 wherein the thickness of the inclined walls is less than the thickness of the cylindrical wall and the axial end wall.

4. The reel according to claim 1 wherein the hub further comprises an inner annular wall positioned radially inward of and extending coaxially within the barrel surface of the cylindrical wall, and wherein the stiffening ribs extend radially inward of the cylindrical wall while terminating radially outward of the inner annular wall.

5. A molded thermoplastic spool for retaining a coiled elongated strand, the spool comprising:

a central core, the core having an inner cylindrical wall defining a hollow space, an outer cylindrical wall positioned coaxially with the inner wall and defining a wire supporting surface, the cylindrical wall extending the length of the central core, and a plurality of radial support ribs extending longitudinally between the inner cylindrical wall and the outer cylindrical wall, the space between the support ribs and the inner and outer walls being hollow;

two axial end walls, one of the end walls attached to the inner wall at each end thereof, the end walls forming a planar surface which extends radially outwardly from the inner wall and perpendicular to the longitudinal axis;

two radially extending support flanges, one flange positioned at each end of the central core, the flanges being attached to the outer cylindrical wall and extending perpendicular to the longitudinal axis and the wire support surface, the support flanges having an outwardly facing surface substantially parallel to the axial end walls; and a plurality of upstanding flange ribs integrally formed with and projecting axially away from the outwardly facing surface of the flange, the flange ribs extending radially inward from substantially the peripheral edge of the flange to at least the peripheral edge of the axial end wall and radially inwardly of the outer cylindrical wall of the central core and terminate radially outward of the inner cylindrical wall of the central core, the flange ribs securing the axial end wall to the outer cylindrical wall.

6. A spool as claimed in claim 5 further comprising two angled walls, each angled wall integrally formed with one of the axial end walls and the corresponding flange, the flange ribs also integrally formed with the angle walls.

7. A spool as claimed in claim 6, wherein the angled walls are formed at an angle of 45° with respect to the longitudinal axis.

8. A spool as claimed in claim 6, wherein the peripheral edges of the axial end walls are radially inward of the position of the outer wall of the central core.

9. A spool as claimed in claim 5, wherein the flange ribs extend radially inward of the peripheral edge of the axial end walls while terminating radially outward of the inner cylindrical wall.

10. A spool as claimed in claim 9 further comprising two angled walls, each angled wall integrally formed with one of the axial end walls and the corresponding flange, the flange ribs also integrally formed with the angle walls.

11. A spool as claimed in claim 10, wherein the thickness of the angle walls is relatively less than the thickness of the inner and outer walls of the central core.

12. A reel comprising:

a central hub, the central hub comprising an outer cylindrical wall defining an outer barrel surface; and an inner cylindrical wall defining a hollow shaft along a central longitudinal axis, the inner and outer cylindrical walls extending the length of the central hub, the inner and outer cylindrical walls being coaxial and radially spaced from one another;

a pair of axial end walls at opposite ends of the barrel surface, the inner cylindrical wall defining a central opening within the axial end walls;

a pair of annular flanges extending radially outward from and integrally formed with the barrel surface adjacent each end wall, each flange also having an outwardly facing surface with integral ribs disposed thereon;

a pair of inclined annular walls the inclined walls forming, at opposite ends of the central hub, an integral connection between the outer cylindrical wall, the axial end walls, the adjacent flange and its corresponding flange ribs;

a plurality of radially extending core ribs disposed on and integrally formed with the inwardly facing surface of at least one of the axial end walls and an inclined annular wall, the core ribs disposed along the longitudinal axis, radially inward of the outer cylindrical wall of the central hub, and radially outward of the inner cylindrical wall of the central hub;

the hub, flanges, core and integral ribs, and inclined walls formed from a thermoplastic material.

13. A reel comprising:

a central hub, the central hub having a cylindrical wall defining an outer barrel surface, the cylindrical wall extending the length of the central hub, the hub also having a pair of axial end walls at opposite ends of the barrel surface;

a pair of annular flanges extending radially outward from and integrally formed with the barrel surface adjacent each end wall, terminating at an axially outward extending flange lip, each flange having an outwardly facing surface;

a plurality of radially extending ribs disposed on and integrally formed with the outwardly facing surface of each of the flanges;

a pair of inclined annular walls, the inclined walls forming an integral connection between the cylindrical wall, the axial end walls and the ribs at each end of the hub;

the top surface of each rib, in the area adjacent the inclined annular walls, is coplanar with the outwardly facing surface of the flanges, each rib gradually tapers toward the outwardly facing surface of the flange as it extends radially outwardly to a low point at a position radially inwardly of the flange lip; the rib continues to extend radially outwardly while tapering upwardly and away from the outwardly facing surface of the flange, integrally forming with the flange lip; and the hub, flanges, ribs and inclined walls formed from a thermoplastic material.

* * * * *